United States Patent [19]

Bacon

[11] 4,022,597

[45] May 10, 1977

[54] SEPARATION OF LIQUID HYDROCARBONS FROM NATURAL GAS

[75] Inventor: Kenneth H. Bacon, Tulsa, Okla.

[73] Assignee: Gulf Oil Corporation, Pittsburgh, Pa.

[22] Filed: Apr. 23, 1976

[21] Appl. No.: 679,834

[52] U.S. Cl. ..... 62/28

[51] Int. Cl.[2] ..... F25J 3/02

[58] Field of Search ..... 62/23, 27, 28, 40, 41

[56] References Cited

UNITED STATES PATENTS

| | | | |
|---|---|---|---|
| 2,600,110 | 6/1952 | Hachmuth | 62/27 |
| 3,274,787 | 9/1966 | Grenier et al. | 62/28 |

FOREIGN PATENTS OR APPLICATIONS

| | | | |
|---|---|---|---|
| 665,385 | 6/1963 | Canada | 62/28 |

*Primary Examiner*—Jack Sofer

[57] ABSTRACT

Ethane and other hydrocarbons of higher boiling point are separated as a liquid from natural gas to leave a gas consisting principally of methane for delivery to a pipeline. The natural gas is passed in countercurrent heat exchange with the liquid product and with the pipeline gas to cool the natural gas to a temperature at which a major part of the ethane is condensed. The condensed ethane and higher boiling point hydrocarbons are separated from uncondensed vapors in the natural gas and the vapors are expanded to a low pressure and delivered into the upper end of a fractionating tower. The condensate is expanded to the same pressure and introduced into the fractionating tower at a midpoint thereof. Gases discharged overhead from the fractionating tower constitute the pipeline gas that is returned to the heat exchanger for countercurrent heat exchange with the natural gas. The liquid hydrocarbons withdrawn from the lower end of the fractionating tower are returned to the heat exchanger for heat exchange with the natural gas to cool the natural gas and to supply heat to vaporize a portion of such liquid products which are returned to the fractionating tower. That part of the liquid product that is not returned to the fractionating tower is compressed, cooled and delivered from the system.

9 Claims, 2 Drawing Figures

SEPARATION OF LIQUID HYDROCARBONS FROM NATURAL GAS

BACKGROUND OF THE INVENTION

1. Field of the Invention

This invention relates to apparatus and a method for the treatment of natural gas and more particularly to the separation of ethane and higher boiling point hydrocarbons from natural gas.

2. Description of the Prior Art

Natural gas produced from gas wells or associated with crude oil produced in oil wells is principally methane but usually contains ethane and hydrocarbons such as propane, butane, etc. having a higher boiling point than ethane. It is desirable to remove the ethane and higher boiling point hydrocarbons from natural gas before delivery of the natural gas to pipelines to recover low boiling point hydrocarbon liquids having a high value and to remove condensable materials from the gas delivered to the pipeline. A substantial quantity of liquids, particularly propane and higher boiling point hydrocarbons, in the natural gas delivered to pipelines can interfere with pumping the gas through the pipeline. Moreover, if there is an appreciable quantity of moisture in the natural gas, solid hydrates will form which may plug pipeline equipment.

The most modern plants used to separate ethane and other higher boiling point hydrocarbons from natural gas utilize a cryogenic process in which the natural gas is cooled to a temperature cool enough to cause condensation of ethane and higher boiling point hydrocarbons. Such plants have required high capital expenditures that could be justified only if there were large quantities of gas to be treated. A recent survey indicated that over 40 percent of the plants for condensation of natural gas liquids from natural gas had capacities for treating in excess of 50,000,000 cu.ft./day of natural gas. Such plants are not installed until it has been proven that there is a substantial gas reservoir that will supply adequate gas for amortization of the large investment for the natural gas liquids plant and to justify a liquids product pipeline to take the liquid hydrocarbon product separated from the gas.

Now that most of the more promising structures have been drilled for oil or gas many of the discovery wells produce relatively small amounts of gas, for example, 1,000,000 to 10,000,000 cu.ft./day. Formerly, if the well were an oil well, the gas would be flared but regulations now prevent flaring. If a gas pipeline is nearby, the associated gas may be delivered to the pipeline without treatment. The added value of the ethane and higher boiling point hydrocarbons in the natural gas is lost to the well owner. Sometimes the well cannot be produced until there is sufficient development of the field to justify one of the larger capacity natural gas liquids plants. The delay in production from the well may have such an adverse effect on the return on investment that the field is not developed.

It is desirable to provide apparatus and a process for the separation from natural gas of ethane and higher boiling point hydrocarbons that will require low capital investment and that are capable of treating small gas flows efficiently. The plant should be portable to permit its easy and rapid transfer from a well after there has been sufficient development of the field around the well to justify a conventional natural gas liquids plant. It is contemplated that the portable plant will then be moved to a new discovery well for recovery of natural gas liquids from the production from that well, and for that reason it is desirable that the plant be operable unattended over a wide range of flow rates.

U.S. Pat. No. 3,292,380 of Bucklin describes apparatus for treating natural gas to recover natural gas liquids. In the apparatus, the gas is cooled to condense some of the higher boiling point hydrocarbons in the gas and the uncondensed vapors expanded in a turbine to reduce the temperature of the vapors to a range at which ethane is condensed. The vapors are delivered into a fractionating tower for separation of methane as an overhead gaseous product from the other hydrocarbons in the natural gas. The hydrocarbons condensed during the cooling are separated from the vapors, flashed to a lower pressure and the liquid resulting from the flashing delivered into the fractionating tower at a midpoint thereof. Power from the turbine is used to compress gas withdrawn from the top of the fractionating tower and from the flash drum to pipeline pressures. The process described in the Bludworth U.S. Pat. No. 3,292,380 is very similar to the process described in U.S. Pat. No. 3,292,380. Other patents describing cryogenic processes for the recovery of natural gas liquids from natural gas are Streich U.S. Pat. No. 3,494,751; Streich U.S. Pat. No. 3,596,472; Swenson et al U.S. Pat. No. 3,393,527 and DiNapoli U.S. Pat. No. 3,359,473. In Streich U.S. Pat. No. 3,596,472, a cascade-type refrigeration process is used to develop temperatures low enough to produce liquefied natural gas.

SUMMARY OF THE INVENTION

This invention resides in a method and apparatus for treating natural gas derived from either natural gas wells or as natural gas associated with crude oil to produce a pipeline gas containing substantially all of the methane in the natural gas and produce as a liquid product a large part of the ethane in the natural gas and substantially all of the hydrocarbons having a boiling point higher than ethane. The natural gas is cooled by countercurrent heat exchange with both the pipeline gas and hydrocarbons from the lower end of fractionating tower used to separate the pipeline gas from ethane and higher boiling point hydrocarbons. The countercurrent heat exchange causes partial condensation of the natural gas which is separated into vapors which are expanded to a low pressure and delivered to the top of the fractionating tower and a condensate which is expanded and delivered to a midpoint of the fractionating tower. A stream of hydrocarbons from the lower end of the fractionating tower that is passed through the heat exchanger countercurrent to the natural gas is returned to the lower end of the fractionating tower to supply reboiler heat for the fractionation.

BRIEF DESCRIPTION OF THE DRAWINGS

Referring to FIG. 1 of the drawings, natural gas at a high pressure preferably in the range of 500 to 1200 psi and at ambient temperature is delivered to the system through line 10. The natural gas is preferably a lean gas in that the ethane and higher boiling point hydrocarbons do not constitute more than about 15 percent of the gas. To prevent freezing of moisture in the natural gas or hydrate formation, an antifreeze material, normally methanol, ethanol or propanol, is injected through line 12 into line 10. If desired, moisture can be removed by suitable dehydrators, for example vessels having a molecular sieve arrangement with suitable means for heating to remove moisture picked up by the molecular sieves, in place of the injection of an antifreeze. Natural gas is delivered through line 10 into a heat exchanger 14 through which it passes in countercurrent heat exchange with pipeline gas produced by the system of this invention and ethane and higher boiling point hydrocarbons, as hereinafter described.

Figure 1:
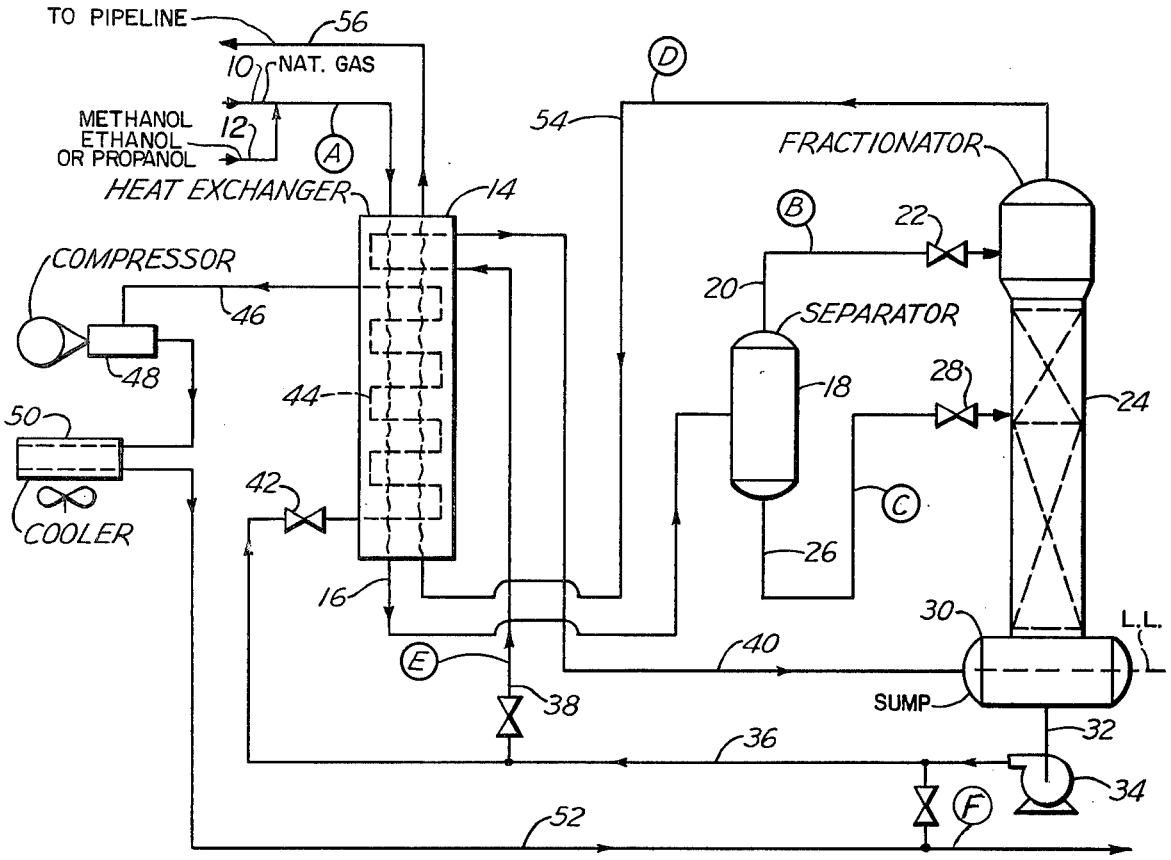
FIG. 1 is a flow sheet showing the process and apparatus of this invention.

It is preferred that the heat exchanger 14 is a plate-fin type of exchanger having a plurality of spaced-apart parallel aluminum plates separated by fins, preferably of corrugated aluminum, in the spaces between the plates. A suitable baffle arrangement is provided to direct the natural gas through certain of the spaces between some of the parallel plates, the pipeline gas through other spaces between other pairs of the parallel plates, and the ethane and higher boiling point hydrocarbons through still other spaces between the parallel plates. A preferred arrangement is one in which the flow of the ethane and higher boiling point hydrocarbons is transverse as well as countercurrent to the flow of the natural gas and the pipeline gas whereby heat transfer is from the natural gas to the ethane and higher boiling point hydrocarbons and from the ethane and higher boiling point hydrocarbons to the pipeline gas, as described in my copending application, U.S. Ser. No. 612,158, filed Sept. 10, 1975, as a continuation-in-part of my U.S. Serial No. 445,451, filed Feb. 25, 1974, now abandoned.

The natural gas is cooled to a temperature below about −70° F. in heat exchanger 14 which causes condensation of some of the ethane and higher boiling point hydrocarbons in the natural gas. If the unit should be used for propane recovery rather than ethane recovery, the temperature of the natural gas is lowered to the range of −40° F. to −70° F. in heat exchanger 14. The mixture of uncondensed vapors and condensate is delivered from the heat exchanger 14 through line 16 into a separator 18. Uncondensed vapors are disengaged from the liquid in separator 18 and discharged from the upper end thereof through line 20. The vapors are expanded in a Joule-Thompson expansion through valve 22 in line 20 to a pressure of approximately 100 to 300 psi. Such expansion reduces the temperature of the vapors to the range of −75° F. to −150° F. and preferably to approximately −150° F. The vapors are discharged into an open space at the upper end of a fractionating tower 24 in which liquids condensed as a result of the temperature drop resulting from the expansion are separated from the uncondensed vapors and serve as a reflux for the fractionating tower. Fractionating tower 24 is filled to approximately the level at which line 20 enters the tower with a packing material providing a large surface area for contact of ascending vapors with descending liquids. Five-eighth inch porcelain Raschig rings are suitable in a tower 12 inches in diameter for handling up to 5,000,000 cu.ft./day of natural gas.

The condensate is withdrawn from the bottom of separator 18 through line 26, expanded through a valve 28 and delivered into fractionating tower 24 at a midpoint thereof. The reduction of pressure in expansion valve 28 results in vaporization of methane dissolved in the condensate and cooling to a temperature of approximately −150° F. The methane ascends through fractionating tower 34 countercurrent to descending reflux to combine with vapors in the upper end of the fractionating tower to form the pipeline gas. Descending liquids are stripped of methane in the lower part of fractionating tower 24 by heat and material transfer with ascending gases.

Hydrocarbon liquids drain into a sump 30 at the bottom of fractionating tower 24 and are withdrawn from the sump through line 32 by a pump 34 and delivered to heat exchanger 14 through line 36. Sump 30 is equipped with a liquid level controller that maintains the liquid level at approximately the midpoint of the sump to facilitate separation of vapors and liquids in the sump. A side stream of the liquids is diverted from line 36 through a line 38 and delivered into the upper end of the heat exchanger 14 for countercurrent heat exchange with the natural gas delivered into the upper end of the heat exchanger through line 10. The gas liquids delivered to the heat exchanger through line 38 are heated to approach the temperature of the natural gas at the inlet-end of the heat exchanger. At that temperature, the gas liquids stream is partly vaporized. The mixture of hydrocarbon vapors and liquids is returned through line 40 into the sump 30 at the bottom of fractionating tower 24 where the vapors are separated and ascend into the tower.

Those hydrocarbon liquids that are not diverted through line 38 are expanded to approximately 20 psia through valve 42 in line 36 to reduce the temperature to approximately −77° F. The expanded hydrocarbons are then passed through a series of passages, indicated by reference numeral 44, in heat exchanger 14 transverse and counter to the flow of natural gas from line 10. The overall flow of the hydrocarbons from line 36 through heat exchanger 14 is countercurrent to the flow of the natural gas. The ethane and higher boiling point hydrocarbons are vaporized in the heat exchanger 14 and discharged therefrom through line 46. Vapors in line 46 are compressed by compressor 48 to a pressure high enough so that the vapors are condensed when cooled in an air cooler 50. The condensed hydrocarbon liquids are delivered from air cooler 50 through line 52 to suitable disposal facilities. Usually, the plant of this invention will not be connected to a liquid products line for delivery of the liquid product to customers or a terminal. The liquid products will then be delivered into a pressure vessel for storage until they can be trucked to the customer.

The overhead product from fractionating tower 24 constitutes the pipeline gas and is delivered through line 54 into the lower end of heat exchanger 14 for countercurrent heat exchange with the natural gas. Pipeline gas is discharged from the upper end of the heat exchanger 14 through line 56 for delivery to the pipeline, either directly or after compression to a higher pressure.

The following table gives the compositions of different streams in a plant for treating a typical natural gas according to this invention with temperatures and pressures at the different locations in the system. The encircled letters in the drawings indicate the locations of the compositions and conditions set forth in the table. The compositions, flow rates, temperatures and pressures set forth in the table are for the purpose of illustration only. This invention is not restricted to such specific conditions and specifications.

TABLE I

| Stream | (A) Natural Gas | (B) Separator Vapor | (C) Condensate Liquid | (D) Pipeline Gas | (E) Reboiler Liquid | (F) Liquid Product |
|---|---|---|---|---|---|---|
| Mols/Hr. | | | | | | |
| $CH_4$ | 474.81 | 351.73 | 123.08 | 474.61 | .26 | .20 |
| $C_2H_6$ | 38.32 | 14.43 | 23.89 | 10.01 | 36.80 | 28.31 |
| $C_3H_8$ | 13.94 | 2.36 | 11.58 | .32 | 17.71 | 13.62 |
| i-$C_4H_{10}$ | 1.65 | .14 | 1.51 | | 2.14 | 1.65 |
| n-$C_4H_{10}$ | 4.01 | .27 | 3.74 | | 5.21 | 4.01 |
| i-$C_5H_{12}$ | .93 | .03 | .90 | | 1.21 | .93 |
| n-$C_5H_{12}$ | 1.26 | .03 | 1.23 | | 1.64 | 1.26 |
| $C_6$+ | .77 | | .77 | | 1.00 | .77 |
| Total Mols/Hr. | 535.69 | 368.99 | 166.70 | 484.94 | 65.97 | 50.75 |
| Temp., ° F. | 110 | −80 | −80 | −146 | 33 | 102.5 |
| Press., psia | 805 | 800 | 800 | 200 | 205 | 450 |

Figure 2:
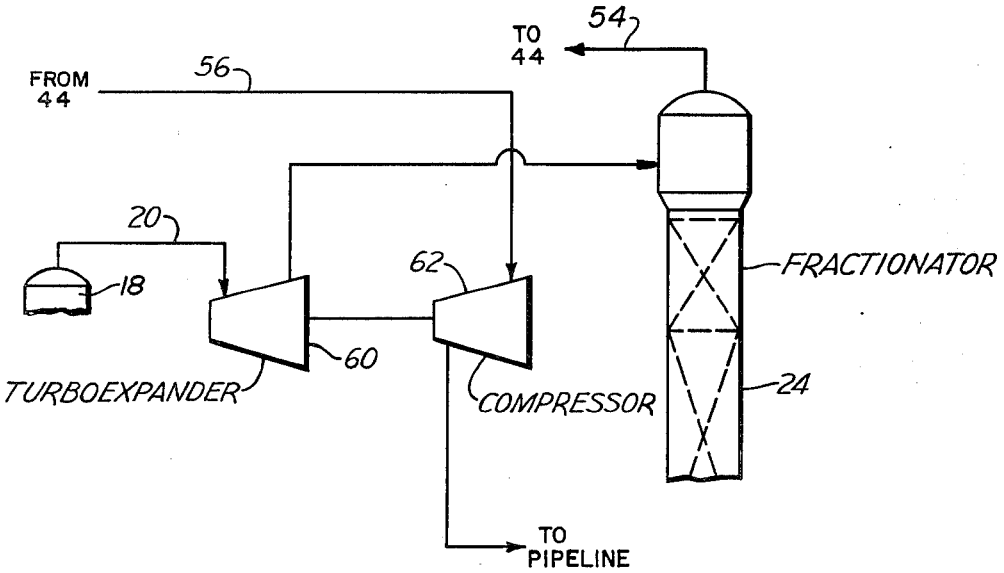
FIG. 2 illustrates an embodiment of the invention in which expansion of the vapors occurs in a turboexpander used to generate power for compression of gas to pipeline pressures.

Referring to FIG. 2 of the drawings, an embodiment is shown in which the expansion of the vapors from separator 18 is accomplished in a turboexpander. Vapors in line 20 are delivered into a turboexpander 60 in which the vapors are expanded from a pressure typically of 800 psi to a pressure of approximately 200 psi. The expanded vapors and resulting condensate are delivered into the upper end of the fractionating tower 24. Turboexpander 60 provides power to drive a compressor 62. Pipeline gas from line 56 is delivered to a compressor 62 and compressed to a higher pressure.

The apparatus and process of this invention provide a compact system that can be preassembled within a supported framework and transported over highways in a horizontal position on a single lowboy trailer to a well. The assembled unit can be lifted from a truck by a crane and either mounted on a previously prepared pad or on skids attached to the frame. It is only necessary to connect the natural gas line, the pipeline gas line and the liquid products line to the appropriate lines at the well and connect motors for the pumps and compressors to electric lines. The system creates no ecological problems in that there is no furnace with an attendant stack. When it is desired to move a unit to another location, it is necessary only to disconnect the natural gas, pipeline gas and liquid products lines and the electric lines. The unit can then be laid on its side on the trailer and transported to another location. Disconnection of the unit at one well and installation at another well can be made within a single day. The apparatus is capable of separating as a liquid product over 70 percent and up to 80 percent of the ethane in the natural gas. Flow rates through the apparatus can be varied as much as five-fold without seriously decreasing the efficiency of recovery of ethane.

I claim:

1. A method for treating natural gas to produce natural gas liquids consisting principally of ethane and higher boiling point hydrocarbons and a pipeline gas consisting principally of methane comprising:

a. passing the natural gas through a heat exchanger in countercurrent indirect heat exchange with separate streams of the pipeline gas and natural gas liquids to cool and partially condense the natural gas;

b. separating the partially condensed natural gas into vapors and condensate;

c. expanding the vapors to a lower pressure and delivering the expanded vapors into the top of a fractionating tower;

d. expanding the condensate to a lower pressure and delivering the expanded condensate to the mid-point of the fractionating tower;

e. withdrawing pipeline gas from the top of the fractionating tower, returning it through the heat exchanger in countercurrent heat exchange with the natural gas as defined in step (a), and discharging from the system the pipeline gas effluent from the heat exchanger;

f. withdrawing natural gas liquids from the bottom of the fractionating tower and passing natural gas liquids in countercurrent heat exchange with the natural gas as set forth in step whereby at least a part of the natural gas liquids is vaporized;

g. returning a portion of the vaporized natural gas liquids from the heat exchange with the natural gas into the lower end of the fractionating tower to supply heat at the lower end of the fractionating tower for the fractionation; and h. discharging from the system natural gas liquids not returned to the fractionating tower.

2. A method as set forth in claim 1 characterized by the natural gas passing in indirect heat exchange with the natural gas liquids and in further heat exchange with the pipeline gas before delivery to the separator.

3. A method as set forth in claim 1 characterized by the heat exchange between the natural gas and the pipeline gas being in a single stage and the vapors and condensate being separated after such heat exchange.

4. A method as set forth in claim 1 characterized by the withdrawal of the natural gas liquids from the fractionating tower being accomplished by pumping the natural gas liquids from the fractionating tower to a pressure higher than the pressure of the fractionating tower and expanding the natural gas liquids to reduce the temperature thereof before heat exchange with the natural gas.

5. A method of treating natural gas at high pressure in the range of 500–1200 psi containing methane, ethane and higher boiling point hydrocarbons to produce a pipeline gas consisting principally of methane and a liquid hydrocarbon product consisting principally of hydrocarbons having a higher boiling point than methane comprising:

a. cooling the natural gas by indirect countercurrent heat exchange in a heat exchanger with separate streams of the pipeline gas and the liquid product to condense a portion of the natural gas;

b. delivering the partially condensed natural gas and liquid condensed therefrom into a separator at substantially the pressure of the natural gas delivered to the heat exchanger;

c. withdrawing separately from the separator a vapor and a condensate;
d. expanding the vapor to a pressure causing a reduction in the temperature to below −40° F.;
e. delivering the expanded vapor into the top of a fractionating tower;
f. expanding the condensate from the separator and delivering the expanded condensate into a midpoint of the fractionating tower;
g. withdrawing from the top of the fractionating tower the pipeline gas consisting principally of methane and passing the pipeline gas in countercurrent heat exchange with the natural gas as specified in step (a);
h. withdrawing from the bottom of the fractionating tower the liquid hydrocarbon product;
i. dividing the liquid product into a first stream and a second stream;
j. expanding the first stream and passing it in countercurrent heat exchange with the natural gas to vaporize hydrocarbons in the first stream as specified in step (a);
k. discharging the thus vaporized first stream into the lower end of the fractionating tower;
l. expanding the second stream and passing the expanded second stream as a separate stream in indirect countercurrent heat exchange with the natural gas to cool the natural gas and vaporize the second stream; and
m. condensing the vaporized second stream and discharging it from the system as liquid product.

6. A method as set forth in claim 5 characterized by:
a. the liquid product containing in excess of 70 percent of the ethane in the natural gas; and
b. the expansion of the vapor in step (d) and the condensate in step (f) of claim 2 reducing the pressure to the range of 100 to 300 psia to reduce the temperature to the range of −75° F. to −200° F.

7. A method as set forth in claim 6 in which the second stream of liquid hydrocarbon product is expanded in step (l) of claim 2 to reduce the pressure to 15 to 50 psia to cool the second stream to substantially the temperature of the separator.

8. A method as set forth in claim 6 in which the expansion of vapors from the separators is accomplished in a turboexpander to generate power and the generated power drives a compressor for compressing the pipeline gas.

9. Apparatus for the treatment of natural gas to produce a pipeline gas and a natural liquids product comprising:
a. a heat exchanger having an inlet end and an outlet end and passages therethrough constructed and arranged to pass the natural gas from the inlet end to the outlet end;
b. means for passing the pipeline gas from the outlet end of the heat exchanger to the inlet end in countercurrent indirect heat exchange with the natural gas;
c. passage means in the heat exchanger for passing natural gas liquids separately from the pipeline gas through the heat exchanger in indirect countercurrent heat exchange with the natural gas;
d. a separator adapted to separate vapors from condensate;
e. means for delivering natural gas fluids from the outlet end of the passages in the heat exchanger to the separator;
f. a fractionating tower;
g. a vapor transfer line having valve means therein extending from the upper portion of the separator to the upper portion of the fractionating tower;
h. a condensate transfer line having valve means therein extending from the bottom of the separator to a midpoint of the fractionating tower;
i. a pipeline gas withdrawal line connected to the upper end of the fractionating tower and to the means for passing the pipeline gas through the heat exchanger from the outlet to the inlet end of the heat exchanger;
j. a natural gas liquids transfer line extending from the lower end of the fractionating tower to the passage means in the heat exchanger;
k. pumping means connected in the natural gas liquids transfer line for delivering natural gas liquids from the fractionating tower to an intermediate portion of the heat exchanger as specified in (c);
l. a valve in the natural gas liquids transfer line between the pump and heat exchanger for expansion of the natural gas liquids; and
m. a return line from the heat exchanger constructed and arranged to return liquids and vaporized natural gas liquids to the lower end of the fractionating tower.

* * * * *

UNITED STATES PATENT AND TRADEMARK OFFICE

CERTIFICATE OF CORRECTION

PATENT NO. : 4,022,597

DATED : May 10, 1977

INVENTOR(S) : Kenneth H. Bacon

It is certified that error appears in the above-identified patent and that said Letters Patent are hereby corrected as shown below:

Column 2, line 22, "3,292,380" should be --3,292,381--.

Column 2, line 43, before "fractionating" insert --a--.

Column 6, line 29, after "step" insert --(a)--.

Column 7, line 44, "claim 2" should be --claim 5--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*